US011306951B2

(12) United States Patent
Scherer

(10) Patent No.: US 11,306,951 B2
(45) Date of Patent: Apr. 19, 2022

(54) REFRIGERATION SYSTEM WITH SEPARATE FEEDSTREAMS TO MULTIPLE EVAPORATOR ZONES

(71) Applicant: PDX Technologies LLC, Houston, TX (US)

(72) Inventor: John Scherer, Santa Monica, CA (US)

(73) Assignee: PDX Technologies LLC, Houston, TX (US)

( * ) Notice: Subject to any disclaimer, the term of this patent is extended or adjusted under 35 U.S.C. 154(b) by 647 days.

(21) Appl. No.: 15/710,566

(22) Filed: Sep. 20, 2017

(65) Prior Publication Data

US 2018/0010830 A1 Jan. 11, 2018

Related U.S. Application Data

(63) Continuation of application No. 14/614,693, filed on Feb. 5, 2015, now Pat. No. 9,791,188.
(Continued)

(51) Int. Cl.
*F25B 31/00* (2006.01)
*F25B 39/02* (2006.01)
(Continued)

(52) U.S. Cl.
CPC ..... *F25B 31/004* (2013.01); *F25B 5/02* (2013.01); *F25B 5/04* (2013.01); *F25B 13/00* (2013.01);
(Continued)

(58) Field of Classification Search
CPC ..... F25B 31/004; F25B 5/02; F25B 13/00; F25B 39/028; F25B 40/06; F25B 41/043;
(Continued)

(56) References Cited

U.S. PATENT DOCUMENTS 2,707,868 A 5/1955 Goodman
2,758,447 A 8/1956 Prosek
(Continued)

FOREIGN PATENT DOCUMENTS

CA 2158899 3/1996
CN 2497245 6/2002
(Continued)

OTHER PUBLICATIONS

Meiyan, Air Conditioning System and Flow Control Method thereof, and Electric Flow Distributor, Jun. 30, 2010, CN101762105A, Whole Document (Year: 2010).*
(Continued)

*Primary Examiner* — Larry L Furdge
(74) *Attorney, Agent, or Firm* — Jeffrey G. Sheldon; Katherine B. Sales; Cislo & Thomas LLP

(57) ABSTRACT

A refrigeration system has: (a) a fluid tight circulation loop including a compressor, a condenser and an evaporator, the evaporator having at least three evaporator zones, each evaporator zone having an inlet port, the circulation loop being further configured to measure the condition of the refrigerant with a refrigerant condition sensor disposed within the evaporator upstream of the evaporator outlet port; and control the flow of refrigerant to the evaporator based upon the measured condition of the refrigerant within the evaporator, and (b) a controller for controlling the flow rate of refrigerant to the evaporator based upon the measured condition of the refrigerant within the evaporator upstream of the evaporator outlet port.

27 Claims, 7 Drawing Sheets

Related U.S. Application Data

(60) Provisional application No. 61/937,033, filed on Feb. 7, 2014, provisional application No. 61/993,865, filed on May 15, 2014.

(51) Int. Cl.

| | |
|---|---|
| ***F25B 41/04*** | (2006.01) |
| ***F25B 5/04*** | (2006.01) |
| ***F25B 5/02*** | (2006.01) |
| ***F25B 40/06*** | (2006.01) |
| ***F25B 13/00*** | (2006.01) |
| ***F25B 49/02*** | (2006.01) |
| ***F28D 1/047*** | (2006.01) |
| ***F28F 27/02*** | (2006.01) |
| ***F28F 9/02*** | (2006.01) |
| ***F28D 1/04*** | (2006.01) |
| ***F25B 41/22*** | (2021.01) |
| *F28D 21/00* | (2006.01) |
| *F25B 41/385* | (2021.01) |

(52) U.S. Cl.

CPC ..... *F25B 39/028* (2013.01); *F25B 40/06* (2013.01); *F25B 41/22* (2021.01); *F25B 49/02* (2013.01); *F28D 1/0417* (2013.01); *F28D 1/0477* (2013.01); *F28F 9/0275* (2013.01); *F28F 27/02* (2013.01); *F25B 41/385* (2021.01); *F25B 2339/02* (2013.01); *F25B 2339/04* (2013.01); *F25B 2341/0683* (2013.01); *F25B 2400/01* (2013.01); *F25B 2600/2513* (2013.01); *F25B 2700/197* (2013.01); *F25B 2700/2117* (2013.01); *F28D 2021/0071* (2013.01); *F28F 2250/06* (2013.01)

(58) Field of Classification Search

CPC .. F25B 49/02; F25B 2339/02; F25B 2339/04; F25B 41/22; F25B 5/04; F25B 41/385; F25B 2700/197; F25B 2341/0683; F25B 2400/01; F25B 2600/2513; F25B 2700/2117; F28D 1/0417; F28D 1/0477; F28D 2021/0071; F28F 9/0275; F28F 27/02; F28F 2250/06

See application file for complete search history.

(56) References Cited

U.S. PATENT DOCUMENTS

| | | | | |
|---|---|---|---|---|
| 3,041,843 | A | 7/1962 | Swearingen et al. | |
| 3,167,930 | A | 2/1965 | Block et al. | |
| 3,170,302 | A | 2/1965 | Potito | |
| 3,240,028 | A * | 3/1966 | Coleman | F25B 47/025 62/156 |
| 4,089,368 | A | 5/1978 | Bell, Jr. et al. | |
| 4,370,868 | A | 2/1983 | Kim et al. | |
| 4,577,468 | A | 3/1986 | Nunn, Jr. et al. | |
| 4,683,726 | A | 8/1987 | Barron | |
| 4,901,533 | A | 2/1990 | Fan et al. | |
| 4,995,453 | A * | 2/1991 | Bartlett | F25B 39/00 165/150 |
| 5,050,400 | A | 9/1991 | Lammert | |
| 5,139,548 | A | 8/1992 | Liu et al. | |
| 5,242,015 | A * | 9/1993 | Saperstein | F28F 1/022 165/163 |
| 5,507,340 | A * | 4/1996 | Alston | F25B 39/02 165/150 |
| 5,540,276 | A * | 7/1996 | Adams | F28D 1/0477 165/150 |
| 5,852,939 | A | 12/1998 | Gazes | |
| 6,026,804 | A | 2/2000 | Schardt et al. | |
| 6,199,401 | B1 | 3/2001 | Haussmann | |
| 6,923,011 | B2 | 8/2005 | Manole | |
| 7,000,413 | B2 | 2/2006 | Chen et al. | |
| 7,841,208 | B2 | 11/2010 | Lefor | |
| 8,646,286 | B2 | 2/2014 | Scherer et al. | |
| 2002/0078699 | A1 | 6/2002 | Vogel et al. | |
| 2003/0145619 | A1 * | 8/2003 | Word | F28D 5/00 62/310 |
| 2004/0154331 | A1 * | 8/2004 | Horiuchi | F25B 39/022 62/509 |
| 2004/0261435 | A1 | 12/2004 | Chen et al. | |
| 2006/0117767 | A1 | 6/2006 | Mowris | |
| 2007/0084594 | A1 | 4/2007 | Higashiyama | |
| 2007/0125120 | A1 | 6/2007 | Marques | |
| 2008/0314064 | A1 | 12/2008 | Al-Eidan | |
| 2009/0090130 | A1 | 4/2009 | Aung et al. | |
| 2010/0043476 | A1 | 2/2010 | Becker et al. | |
| 2010/0089079 | A1 | 4/2010 | Bauer et al. | |
| 2010/0132399 | A1 | 6/2010 | Mitra et al. | |
| 2010/0229579 | A1 | 9/2010 | Knight et al. | |
| 2011/0005268 | A1 | 1/2011 | Oshitani et al. | |
| 2011/0209857 | A1 * | 9/2011 | Naukkarinen | F28D 7/02 165/164 |
| 2013/0086930 | A1 | 4/2013 | Scherer et al. | |
| 2013/0133868 | A1 | 5/2013 | Lehar et al. | |
| 2014/0123696 | A1 * | 5/2014 | Kim | F25B 41/30 62/498 |
| 2014/0157808 | A1 | 6/2014 | Scherer et al. | |

FOREIGN PATENT DOCUMENTS

| | | | |
|---|---|---|---|
| CN | 101285633 | A | 10/2008 |
| CN | 101762105 | A * | 6/2010 |
| CN | 103528281 | A | 1/2014 |
| DE | 3600075 | | 7/1986 |
| DE | 19719251 | | 11/1998 |
| JP | 2002286307 | | 10/2002 |
| JP | 2005291622 | | 10/2005 |
| JP | 2007198664 | | 8/2007 |
| JP | 2009-85569 | A | 4/2009 |
| JP | 2009-257742 | A | 11/2009 |
| JP | 2012-57939 | A | 3/2012 |
| JP | 2013-134025 | A | 7/2013 |
| JP | 2014-501381 | A | 1/2014 |
| JP | 2014501381 | | 1/2014 |
| MX | 335421 | | 12/2015 |
| WO | WO 2006112157 | | 10/2006 |
| WO | WO 2012092274 | | 7/2012 |
| WO | WO 2015120241 | | 8/2015 |

OTHER PUBLICATIONS

Australian Government, IP Australia, "Examination Report No. 1 for your Standard Patent Application," dated Oct. 16, 2017 for Australian Application No. 2011352288, 7 pages.

European Patent Office, Communication Pursuant to Article 94(3) EPC dated Apr. 12, 2018 for Application No. 15 746 757.2-1008, 4 pages.

Japanese Patent Office, "Notice of Reasons for Rejection (Office Action)" dated Dec. 4, 2018 for Application No. 2016-550602, 13 pages.

European Patent Office, Supplementary European Search Report for EP 15 74 6757 dated Aug. 16, 2017, 9 pages.

Patent Cooperation Treaty, International Search Report and Written Opinion dated Apr. 10, 2012 for PCT/US2011/067390, 7 pages.

Man'o, Tatsunori et al., Improvements of Heat Transfer and Refrigerant Distribution in Plate-type Evaporator by Vapor Recirculation Using an Ejector, The Smithsonian/NASA Astrophysics Data System, Jun. 3, 2014, 1 page.

Scherer, John et al., U.S. Appl. No. 61/428,576, filed Dec. 12, 2010 entitled "Refrigeration System."

Scherer, John et al., U.S. Appl. No. 13/312,706, filed Dec. 6, 2011 entitled "Refrigeration System Controlled by Refrigerant Quality Within Evaporator."

Scherer, John et al., U.S. Patent Publicaiton No. 2014/0157808, Published on Jun. 12, 2014 entitled, "Refrigeration System Controlled by Refrigerant Quality Within Evaporator."

(56) References Cited

OTHER PUBLICATIONS

Scherer, John et al., U.S. Appl. No. 61/937,033, filed Feb. 7, 2014 entitled, "Refrigeration System with Seperate System with Separate Feedstreams to Multiple Expanding Evaporator Zones."
Scherer, John et al. International Application PCT/US15/14767, Filed Feb. 6, 2015 entitled, "Refrigeration System with Sperate Feedstreams to Multiple Evaporator Zones."
International Search Report and Written Opinion dated May 26, 2015 in PCT/US2015/014767.
WIPO/KIPO, International Preliminary Report on Patentability (IPRP) issued in related PDX TEchnologies LLC, International Patent Applicaiton No. PCT/US2015/014767 dated Aug. 9, 2016, 9 pages.
CIPO, Office Action issued in related PDX Technologies Canadian Patent Application No. 2,862,159, dated Nov. 18, 2015, 4 pages.
JPO, Office Action issued in related PDX Technologies Japanese Patent Application No. 2013-547612, dated Oct. 6, 2015, 6 pages.
JPO, Second Office Action issued in related PDX Technologies Japanese Patent Application No. 2013-547612, dated May 31, 2016, 5 pages.
Scherer, John S., U.S. Appl. No. 61/993,865 titled "Refrigeration System With Warming Feature" filed May 15, 2014.
WIPO/KIPO, International Preliminary Report on Patentability (IPRP) issued in related Scherer et al. International Patent Application No. PCT/US2011/067390, dated Jul. 2, 2013, 5 pages.
USPTO, First Office Action on the Merits issued in Scherer U.S. Appl. No. 13/312,706, filed Jun. 7, 2013.
International Search Report and Written Opiniondated Apr. 10, 2012 in PCT/US2011/067390.
Japanese Patent Office, "Notice of Reasons for Rejection (Office Action)" dated May 28, 2019 for Application No. 2016-550602.
European Patent Office, "European Search Report" dated Jul. 12, 2017 for PCT/US2011067390, 10 pages.

* cited by examiner

REFRIGERATION SYSTEM WITH SEPARATE FEEDSTREAMS TO MULTIPLE EVAPORATOR ZONES

RELATED APPLICATIONS

This application is a continuation of U.S. patent application Ser. No. 14/614,693 entitled, "REFRIGERATION SYSTEM WITH SEPARATE FEEDSTREAMS TO MULTIPLE EVAPORATOR ZONES," filed Feb. 5, 2015, which claims priority from U.S. Patent Application Ser. No. 61/937,033 entitled "REFRIGERATION SYSTEM WITH SEPARATE FEEDSTREAMS TO MULTIPLE EXPANDING EVAPORATOR ZONES," filed Feb. 7, 2014, and from U.S. Patent Application Ser. No. 61/993,865 entitled "REFRIGERATION SYSTEM WITH WARMING FEATURE," filed May 15, 2014, the entireties of which are incorporated herein by reference.

BACKGROUND

Refrigeration systems comprising a compressor, a condenser and an evaporator come in a wide variety of configurations. The most common of these configurations is generally termed a "direct expansion system." In a direct expansion system, a refrigerant vapor is pressurized in the compressor, liquefied in the condenser and allowed to revaporize in the evaporator and then flowed back to the compressor.

In direct expansion systems, the amount of superheat in the refrigerant vapor exiting the evaporator is almost exclusively used as a control parameter. Direct expansion systems operate with approximately 20% to 30% of the evaporator in the dry condition to develop superheat.

A problem with this control method is that superheat control is negatively effected by close temperature differences, wide fin spacing or pitch, light loads and water content. The evaporator must be 20% to 30% larger for equivalent surface to be available. Also, superheat control does not perform well in low-temperature systems, such as systems using ammonia or similar refrigerant, wherein the evaporator temperatures are about 0° F.

An additional disadvantage of the superheat control method is that it tends to result in excessive inlet flashing. Such inlet flashing results in pressure drop and instability transfer within the evaporator, and results in the forcible expansion of liquid out of the distal ends of the evaporator coils. Also, this control method is especially problematic when the refrigerant is ammonia or other low-temperature refrigerant, because so much liquid refrigerant is typically expelled from the evaporator to require the use of large liquid traps downstream of the evaporator.

Thus, in all superheat controlled expansion systems, negative compromises are necessarily made in efficiency and capacity.

The aforementioned problems have largely been overcome by the recent development of a refrigeration system control method wherein evaporator feed rate is controlled in response to refrigerant condition measured within the system evaporator. (See in U.S. patent application Ser. No. 13/312,706, entitled "REFRIGERATION SYSTEM CONTROLLED BY REFRIGERANT QUALITY WITHIN EVAPORATOR," filed Dec. 6, 2011.) However, there remains a strong incentive for even greater efficiencies.

SUMMARY OF THE INVENTION

The invention provides a refrigeration system with such greater efficiencies. In one aspect, the invention is a refrigeration system comprising: (a) a fluid tight circulation loop including a compressor, a condenser and an evaporator, the circulating loop being configured to continuously circulate a refrigerant which is capable of existing in a liquefied state, a gaseous state and a two-phase state comprising both refrigerant in the liquefied state and refrigerant in the gaseous state, the evaporator having an outlet port and at least three evaporator zones, each evaporator zone having an inlet port, the circulation loop being further configured to (i) compress refrigerant in a gaseous state within the compressor and cool the refrigerant within the condenser to yield refrigerant in the liquefied state; (ii) flow refrigerant from the condenser into the evaporator via the inlet ports of each evaporator zone, wherein the refrigerant partially exists in a two-phase state; (iii) flow refrigerant from the evaporator to the compressor; (iv) repeat steps (i)-(iii); (v) measure the condition of the refrigerant with a refrigerant condition sensor disposed within the evaporator upstream of the evaporator outlet port; and (vi) control the flow of refrigerant to the evaporator in step (ii) based upon the measured condition of the refrigerant within the evaporator from step (v); and (b) a controller for controlling the flow rate of refrigerant to the evaporator based upon the measured condition of the refrigerant within the evaporator upstream of the evaporator outlet port.

In another aspect, the invention is a method of employing the refrigeration system, comprising the steps of: (a) compressing refrigerant in a gaseous state within the compressor and cooling the refrigerant within the condenser to yield refrigerant in the liquefied state; (b) flowing refrigerant from the condenser into the evaporator via the inlet ports of each evaporator zone, wherein the refrigerant partially exists in a two-phase state; (c) flowing refrigerant from the evaporator to the compressor; (d) repeating steps (a)-(c); (e) measuring the condition of the refrigerant with a refrigerant condition sensor disposed within the evaporator upstream of the outlet port; and (f) controlling the flow rate of refrigerant to the evaporator in step (b) based upon the measured condition of the refrigerant condition of the refrigerant from step (e).

DRAWINGS

Features, aspects and advantages of the present invention will become better understood with reference to the following description, appended claims, and accompanying drawings where:

DETAILED DESCRIPTION OF THE INVENTION

Figure 1:
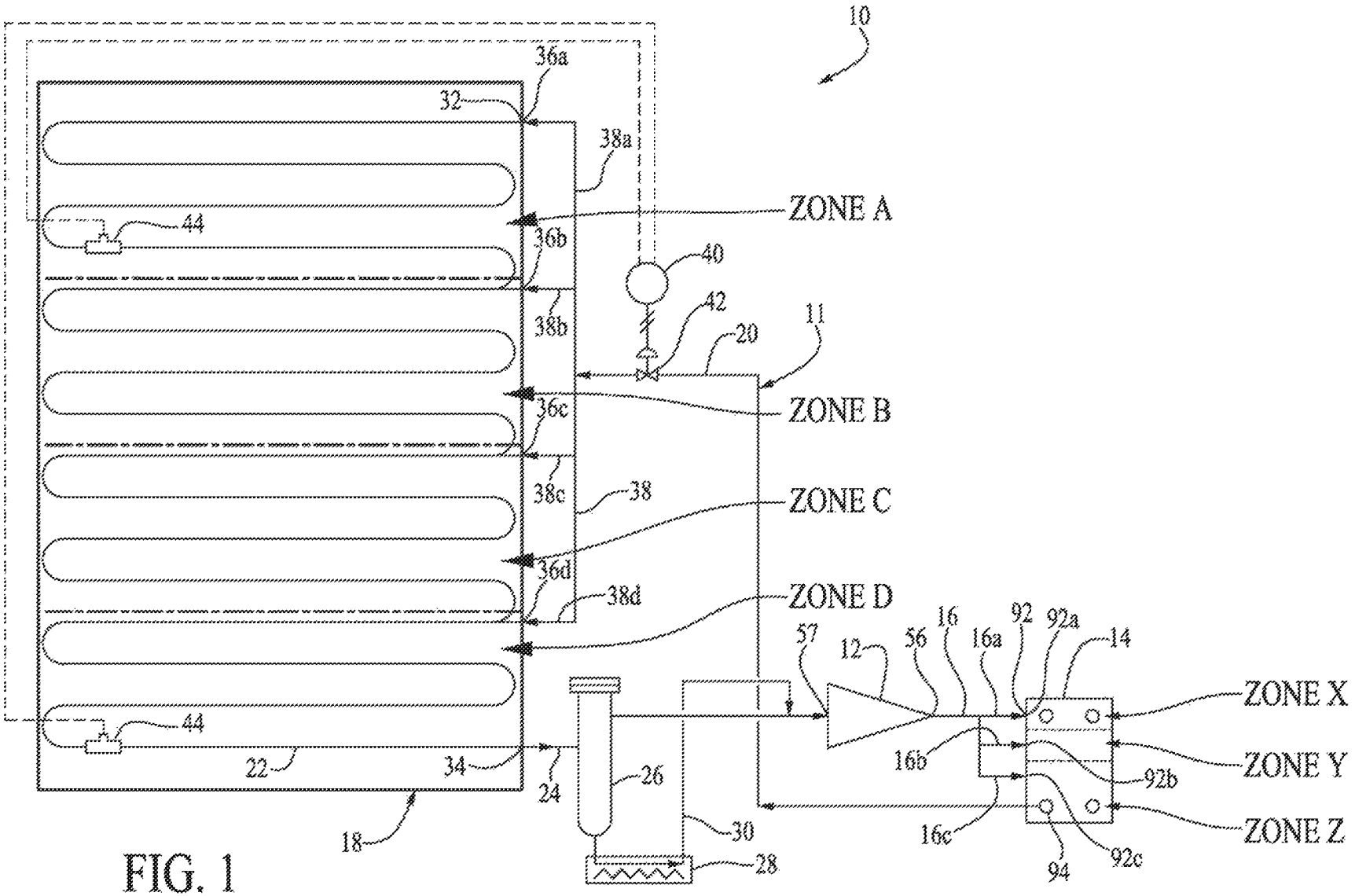
FIG. 1 is a flow diagram illustrating a first refrigeration system having features of the invention.

The following discussion describes in detail one embodiment of the invention and several variations of that embodiment. This discussion should not be construed, however, as limiting the invention to those particular embodiments. Practitioners skilled in the art will recognize numerous other embodiments as well.

Definitions

As used herein, the following terms and variations thereof have the meanings given below, unless a different meaning is clearly intended by the context in which such term is used.

The terms "a," "an," and "the" and similar referents used herein are to be construed to cover both the singular and the plural unless their usage in context indicates otherwise.

As used in this disclosure, the term "comprise" and variations of the term, such as "comprising" and "comprises," are not intended to exclude other additives, components, integers, ingredients or steps.

The Invention

The invention is a refrigeration system 10 and a method for controlling the operation of the refrigeration system 10. The refrigeration system 10 comprises a fluid tight circulation loop 11 including a compressor 12, a condenser 14 and an evaporator 18.

The compressor 12 has a discharge side 56 and a suction side 57. The condenser 14 has at least one condenser input port 92 and a condenser outlet port 94. The evaporator 18 has at least three evaporator input ports 36 and an evaporator outlet port 34.

The circulating loop 11 is configured to continuously circulate a refrigerant which is capable of existing in a liquefied state, a gaseous state and a two-phase state comprising both refrigerant in the liquefied state and refrigerant in the gaseous state.

The evaporator 18 preferably comprises at least one continuous length of tubing 22 having an inlet opening 32—which constitutes one of the evaporator inlet ports 36—and a discharge opening 33—which constitutes the evaporator outlet port 34. In such embodiments the at least one continuous length of tubing 22 comprises the least three evaporator zones, an upstream-most evaporator zone, a downstream-most evaporator zone and one or more intermediate evaporator zones. Each evaporator zone has one or more evaporator input ports 36. The evaporator inlet port 36*a* for the upstream-most evaporator zone is the inlet opening 32 of the at least one continuous length of tubing 22. Refrigerant introduced into each evaporator zone through its inlet port 36 flows directly into the next evaporator zone in series until the refrigerant exits the evaporator through the outlet port 34.

In the invention, refrigerant from the condenser 14 is divided into separate feed streams, one feed stream being in fluid tight communication with the refrigerant inlet port 36 of each of the evaporator zones.

The circulation loop 11 is further configured to (i) compress refrigerant in a gaseous state within the compressor 12 and cool the refrigerant within the condenser 14 to yield refrigerant in the liquefied state; (ii) flow refrigerant from the condenser 14 into the evaporator 18 via the inlet port 36 of each evaporator zone, wherein the refrigerant partially exists in a two-phase state; (iii) flow refrigerant from the evaporator 18 to the compressor 12; (iv) repeat steps (i)-(iii); (v) measure the condition of the refrigerant with a refrigerant condition sensor 44 disposed within the evaporator 18 upstream of the evaporator outlet port 34; and (vi) control the flow of refrigerant to the evaporator 18 in step (ii) based upon the measured condition of the refrigerant within the evaporator 18 from step (v).

Control of the refrigerant flow to the evaporator 18 in step (ii) is provided by an evaporator feed rate controller 40. The evaporator feed rate controller 40 controls the flow rate of refrigerant to the evaporator 18 based upon the measured condition of the refrigerant within the evaporator 18 upstream of the evaporator outlet port 34.

In the invention, the cross-sectional area of the tubing 22 within each evaporator zone is preferably less than the cross-sectional area of the tubing 22 within the next downstream evaporator zone. Also, it is preferable that the cross-sectional areas of the tubing 22 within the upstream-most evaporator zone and within each intermediate evaporator zone smoothly and continuously expands from its inlet port 36 to the inlet port 36 of the next downstream evaporator zone. Typically, the continuous length of tubing 22 continually and smoothly expands from the inlet port 36*a* of the most upstream evaporator zone to the evaporator outlet port 34.

It is also typical for the at least one continuous length of tubing 22 to have a circular cross-section with a cross-sectional diameter at its inlet opening 32 of between about 0.375" and 0.75" with a cross-sectional diameter at its discharge opening of between about 0.5" and 0.875".

The condenser 14 can also be divided into multiple condenser zones—with each condenser zone having one or more condenser inlet ports 92. In the embodiments illustrated in the drawings, the condenser 14 comprises three condenser zones, an upstream condenser zone, an intermediate condenser zone and a downstream condenser zone. In these embodiments, pressurized refrigerant from the compressor 12 is divided into separate pressurized refrigerant feed lines 16, one pressurized refrigerant feed lines 16 being in fluid tight communication with a condenser inlet port 92 of each of the condenser zones.

FIGS. 1-4 illustrate four embodiments of the refrigeration system 10 of the invention. In the embodiment illustrated in FIG. 1, gaseous refrigerant is pressurized in a compressor 12 and flowed to a condenser 14 via a pressurized refrigerant line 16. In the condenser 14, the refrigerant is brought into thermal contact with a coolant, such as cooling water, and is thereby condensed to a liquid state. From the condenser 14, the refrigerant is flowed to an evaporator 18 via an evaporator feed line 20. In the at least one continuous length of tubing 22 within the evaporator 18, the refrigerant is converted to its gaseous state through the absorption of heat. From the evaporator 18, the refrigerant flows via an evaporator discharge line 24 back to the compressor 12.

In the embodiments illustrated in FIGS. 1-4, a drop leg 26 is disposed within the evaporator discharge line 24. During normal operation, trace amounts of refrigerant liquid and lubricating exiting the evaporator 18 travel at comparatively high velocity directly to the suction side 57 of the compressor 12. During abnormal operation, for example at very light load or during start up after a power failure, refrigerant liquid and lubricating oil collect at the low point of the drop leg 26. Heat added to the bottom of the drop leg 26 and/or heat provided by a drop leg heater 28 evaporates the small amounts of refrigerant liquid and warms high viscosity liquids. Thereafter, the refrigerant liquid and oil separated into the low point of the drop leg 26 is returned to the compressor 12 through a drop leg heater return line 30.

In the embodiment illustrated in the drawings, the at least one continuous length of tubing 22 is divided into four zones. Zone A is the upstream-most evaporator zone, zone B is a first intermediate evaporator zone, zone C is a second intermediate evaporator zone and zone D is the downstream-most evaporator zone. Each evaporator zone has a refrigerant input port, input ports 36*a*-36*d*, respectively. The refrigerant inlet port 36*a* for evaporator zone A is the inlet opening 32 of the at least one continuous length of tubing 22.

In the embodiment illustrated in the FIG. 1, refrigerant from an evaporator feed line 20 is divided into four separate evaporator feed streams 38, one evaporator feed stream being in fluid tight communication with a refrigerant inlet port 36 of each of the evaporator zones. In the embodiment illustrated in FIG. 1, the division of incoming refrigerant from the evaporator feed line 20 is made so that the flow of refrigerant to each of the four evaporator zones is substantially equal.

The total incoming refrigerant from the evaporator feed line 20 is controlled by an evaporator feed rate controller 40 which sends signals to an evaporator feed input control valve or injector 42. The evaporator feed rate controller 40 receives signals concerning the condition of the refrigerant within the evaporator 18 from one or more refrigerant quality sensors 44 disposed within the evaporator 18 upstream of, the discharge opening 34 of the evaporator. Preferably, one such refrigerant condition sensor 44 is disposed within the evaporator 18 proximate to the discharge opening 34 of the evaporator. Use and operation of refrigerant condition sensors disposed within a refrigeration evaporator 18 is discussed in detail in U.S. patent application Ser. No. 13/312,706, entitled "REFRIGERATION SYSTEM CONTROLLED BY REFRIGERANT QUALITY WITHIN EVAPORATOR," filed Dec. 6, 2011, the entirety of which is incorporated herein by reference.

In the embodiment illustrated in the FIG. 1, the condenser 14 is divided into three condenser zones. Condenser zone X is the upstream-most condenser zone, condenser zone Y is an intermediate condenser zone and condenser zone Z is the downstream-most condenser zone. Each condenser zone has a condenser input port, condenser input ports 92*a*-92*c*, respectively.

In the embodiment illustrated in the FIG. 1, refrigerant from a pressurized refrigeration line 16 is divided into three separate condenser feed streams, one evaporator feed stream being in fluid tight communication with the condenser inlet port 92 of each condenser zone. In the embodiment illustrated in FIG. 1, the division of incoming refrigerant from the pressurized refrigerant line 16 is made so that the flow of refrigerant to each of the three condenser zones is substantially equal.

Figure 2:
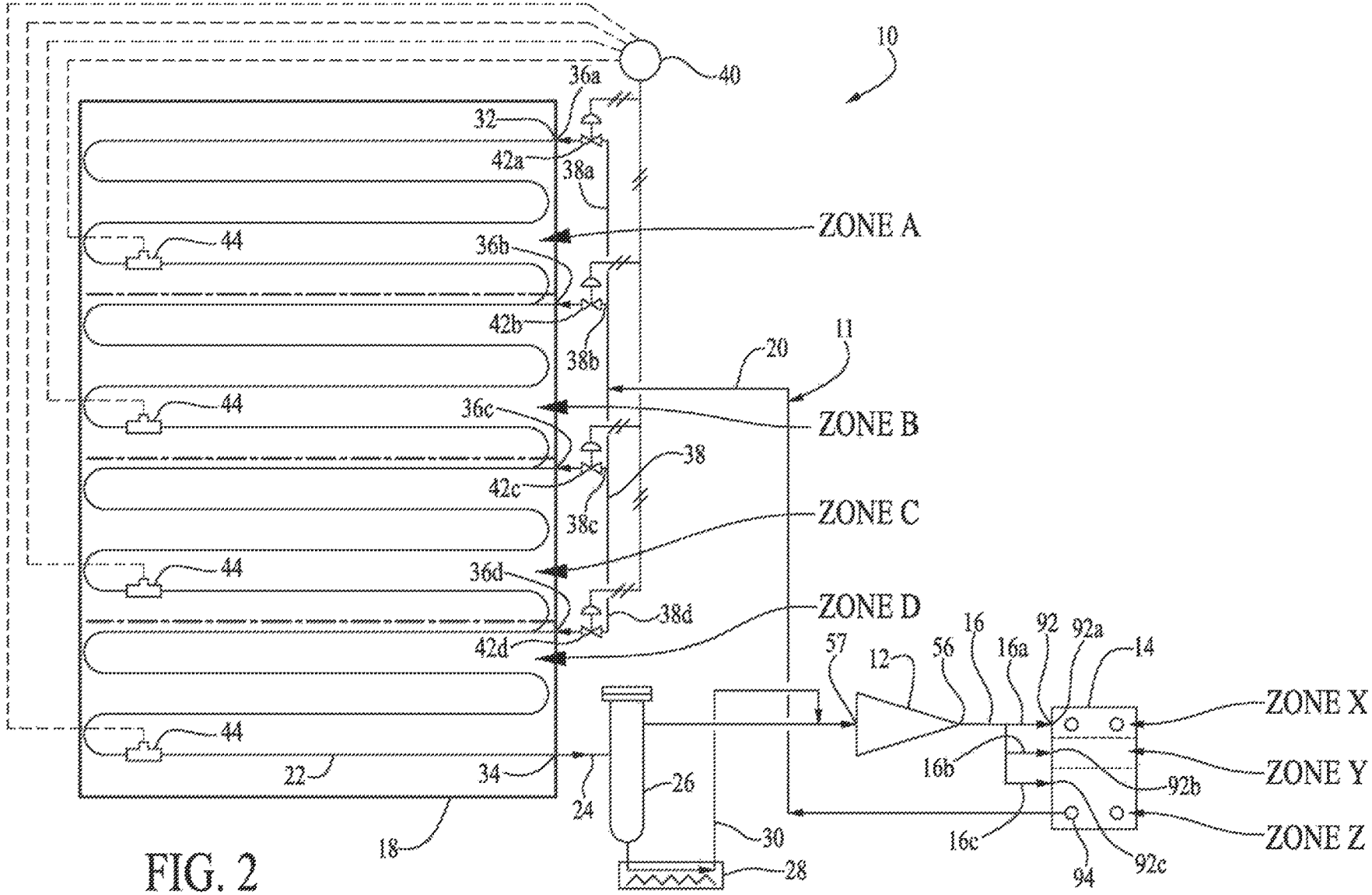
FIG. 2 is a flow diagram illustrating a second refrigeration system having features of the invention.

FIG. 2 illustrates an embodiment of the refrigeration system 10 similar to the embodiment illustrated in FIG. 1, except that each of the evaporator feed streams 38 to the four evaporator zones are separately controlled by the evaporator feed rate controller 40 which sends signals to separate feed input control valves or injectors 42. The evaporator feed rate controller 40 for each of the evaporator zones receives input signals from one or more refrigerant condition sensors 44 disposed within each evaporator zone.

Figure 3:
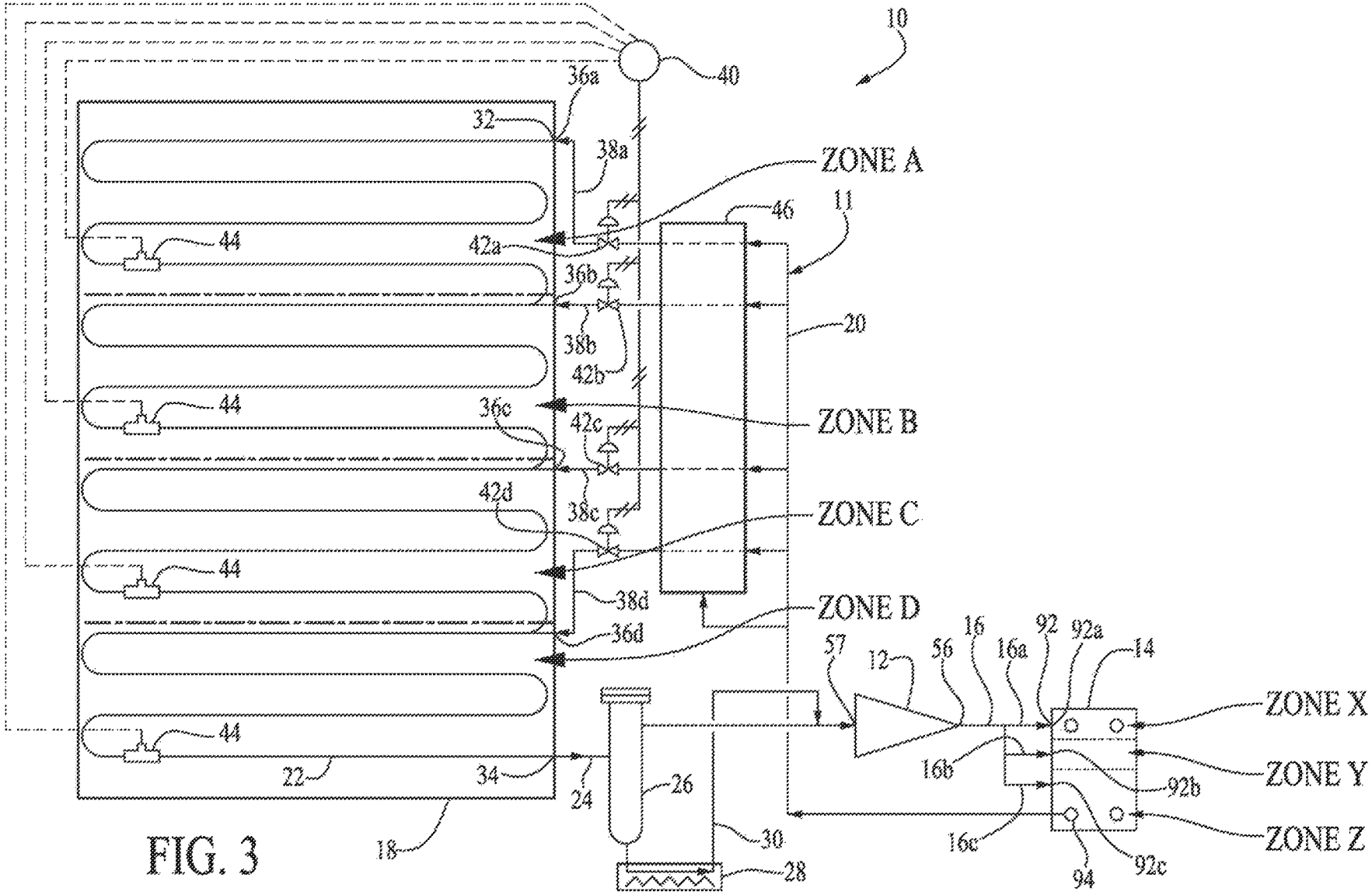
FIG. 3 is a flow diagram illustrating a third refrigeration system having features of the invention; is a first refrigeration system having features of the invention.

FIG. 3 illustrates an embodiment of the refrigeration system 10 similar to the embodiment illustrated in FIG. 2, except that the separate evaporator feed streams 38 to the four evaporator zones are first precooled by thermal contact with evaporating refrigerant in an evaporator feed precooler 46. Use and operation of an evaporator feed precooler 46 is also discussed in detail in U.S. patent application Ser. No. 13/312,706.

Figure 4:
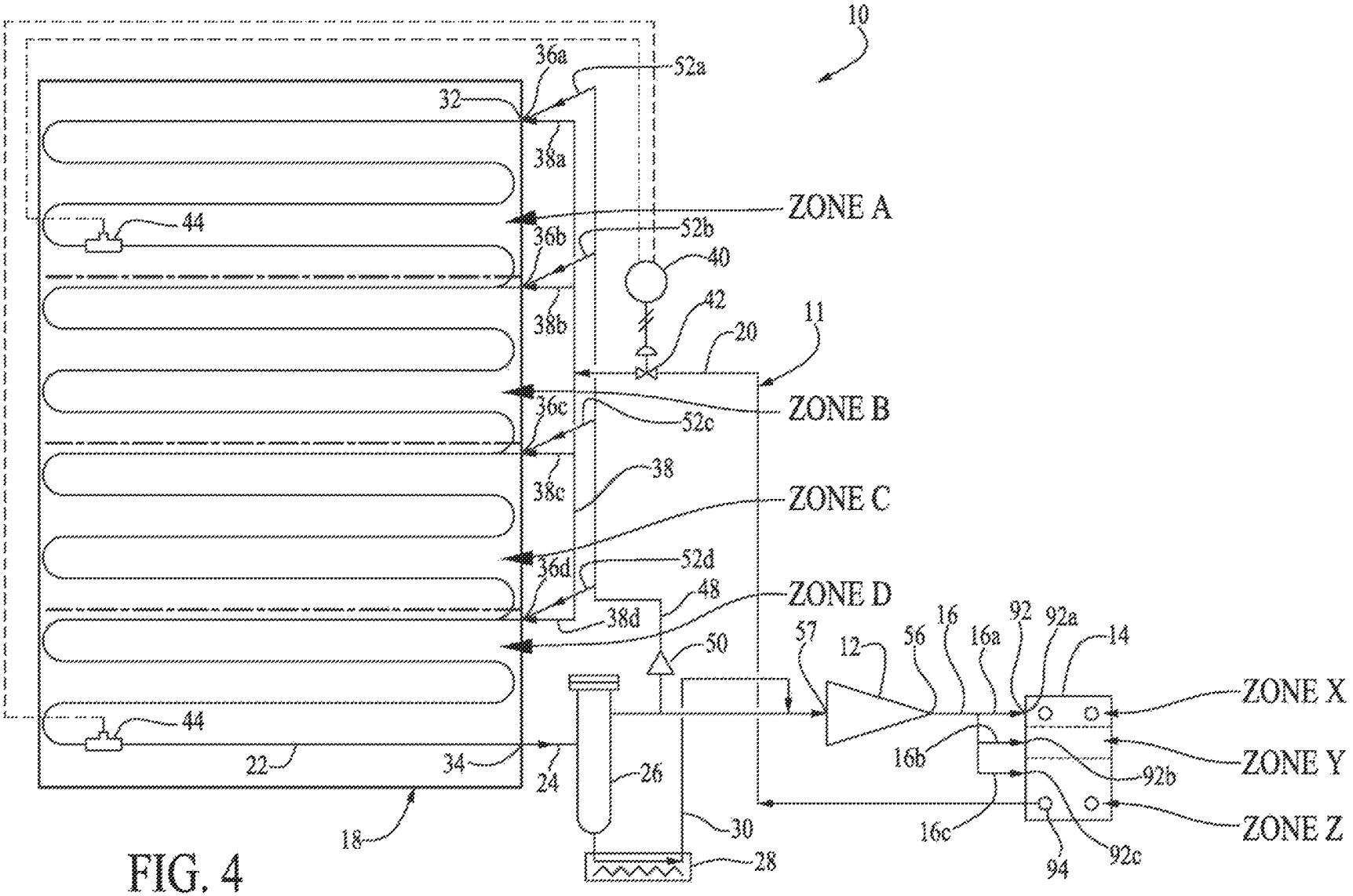
FIG. 4 is a flow diagram illustrating a fourth refrigeration system having features of the invention; is a first refrigeration system having features of the invention.

FIG. 4 illustrates an embodiment of the refrigeration system 10 similar to the embodiment illustrated in FIG. 1, with the addition of an evaporator discharge vapor recycle line 48 for recycling some of the refrigerant vapor from the evaporator discharge line 24, through an evaporator discharge vapor pressure booster 50 and into evaporator discharge vapor injectors 52 for injecting refrigerant vapor into each of the refrigerant input ports 36. In this embodiment, the evaporator feed rate controller 40 again modulates the flow of refrigerant evaporator feed with the evaporator feed input control valve or injector 42 based on refrigerant quality within the evaporator 18 as sensed by the refrigerant condition sensors 44. The evaporator discharge vapor pressure booster 50 is operated to maintain two phase refrigerant volume in the evaporator 18 at equilibrium under all loading conditions.[HOW?]

Figure 5:
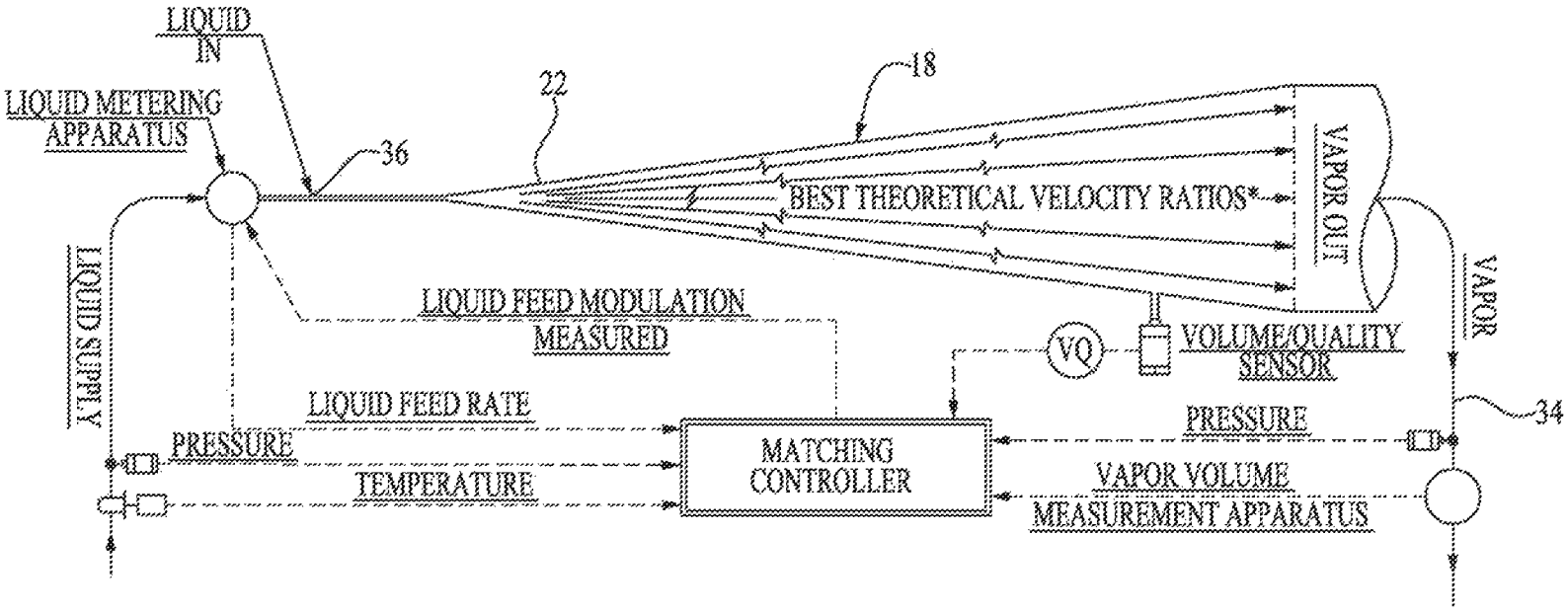
FIG. 5 is a diagrammatic representation of a continuously expanding continuous tube within an evaporator useable in the invention.

FIG. 5 illustrates an example of a continuous length of tubing 22 within a refrigeration system evaporator 18 which smoothly and continuously expands from an inlet port to a discharge port. Use and operation of a continuous length of tubing 22 within a refrigeration system evaporator 18 which smoothly and continuously expands from an inlet port to a discharge port is also discussed in detail in U.S. patent application Ser. No. 13/312,706.

In operation, the above described refrigeration system 10 can be employed to perform the following steps: (a) compress refrigerant in a gaseous state within the compressor 12 and cooling the refrigerant within the condenser 14 to yield refrigerant in the liquefied state; (b) flow refrigerant from the condenser 14 into the evaporator via the inlet ports 36 of each evaporator zone, wherein the refrigerant partially exists in a two-phase state; (c) flow refrigerant from the evaporator 18 to the compressor 12; (d) repeat steps (a)-(c); (e) measure the condition of the refrigerant with a refrigerant condition sensor disposed within the evaporator 18 upstream of the evaporator outlet port 34; and (f) control the flow rate of refrigerant to the evaporator 18 in step (b) based upon the measured condition of the refrigerant from step (e).

Figure 6:
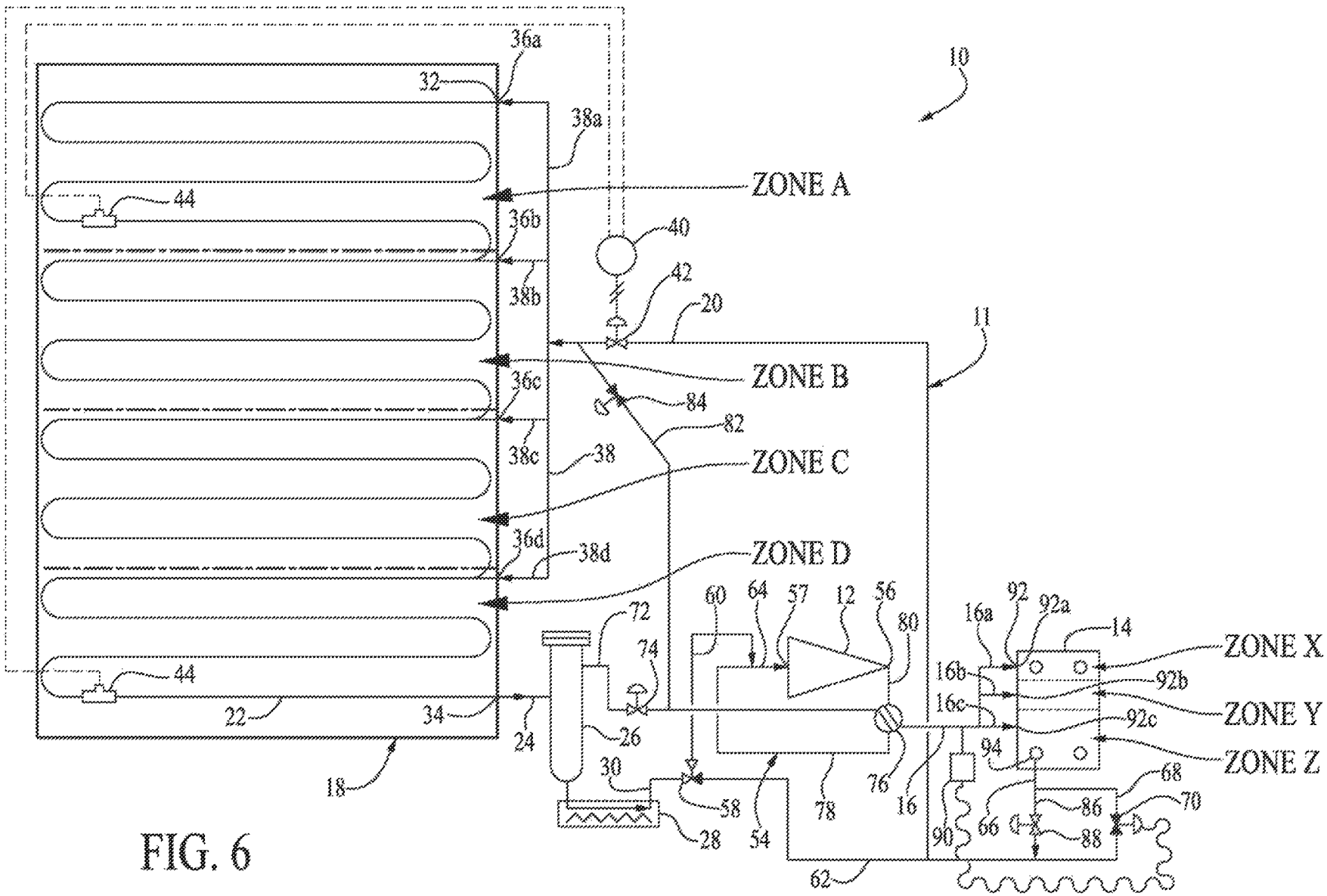
FIG. 6 is a flow diagram illustrating a fifth refrigeration system having features of the invention; is a first refrigeration system having features of the invention.
Figure 7:
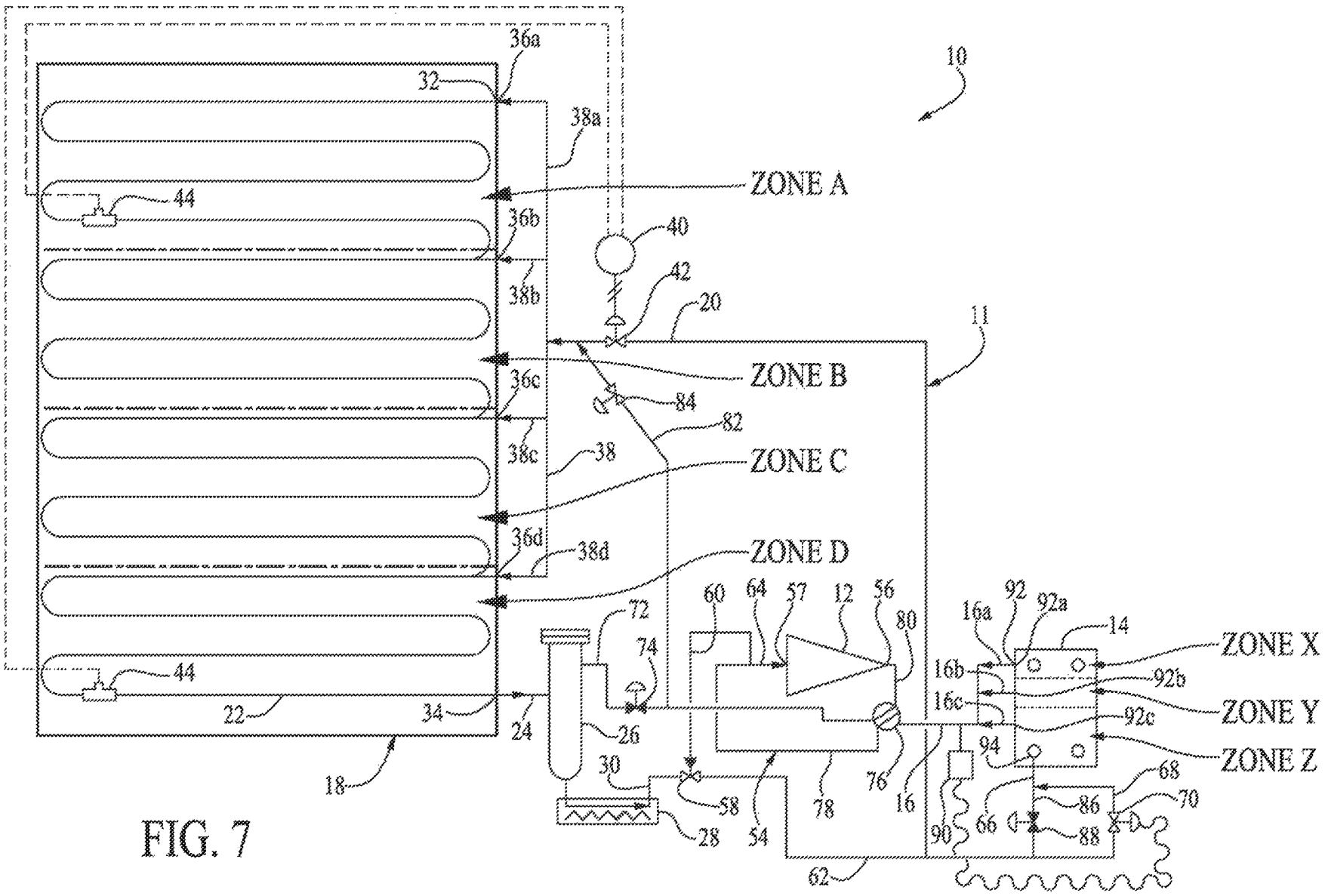
FIG. 7 is a flow diagram illustrating a sixth refrigeration system having features of the invention; is a first refrigeration system having features of the invention.

The refrigeration system 10 of the invention can further comprise alternative vapor flow paths to periodically route warm refrigerant vapor to either the evaporator 18 or the condenser 14, or to both the evaporator 18 and the condenser 14—to warm unduly chilled portions of the evaporator 18 and/or the condenser 14. FIGS. 6 and 7 illustrate an embodiment having such alternative vapor flow paths.

FIGS. 6 and 7 illustrate an embodiment of a refrigeration system 10 similar to the refrigeration system 10 illustrated in FIG. 1 with respect to evaporator feed controls. In the embodiments illustrated in FIGS. 6 and 7, the refrigeration system 10 further comprises reversing conduits and valves 54 for alternatively (i) flowing refrigerant from the discharge side 56 of the compressor 12 to the evaporator inlet ports 36 without first flowing the refrigerant to the condenser 14, (ii) flowing refrigerant exiting the evaporator 18 to the outlet port 94 of the condenser 14, (iii) flowing refrigerant from the condenser outlet port 94, through the condenser 14 to the condenser inlet ports 92 and (iii) flowing refrigerant from the condenser inlet ports 92 to the suction side 57 of the compressor 12.

In the embodiment illustrated in FIGS. 6 and 7, refrigerant liquid and oil separated into the low point of the drop leg 26 and heated in the drop leg heater 28 is directed via a drop leg heater return line 30 to a 3-way valve 58—from where it is alternatively directed to a first heated separates line 60 or to a second heated separates line 62. The first heated separates line 60 is connected to a compressor inlet line 64. The second heated separates line 62 is connected to a first condenser discharge line 66 via a condenser warming line 68 having a condenser warming line valve 70. The operation of the condenser warming line valve 70 is controlled by a condenser warming line controller 90 which responds to the temperature of refrigerant in the pressurized refrigerant line 16.

Reduced pressure refrigerant vapor from the top of the drop leg 26 is removed to a 4-way valve 76 via a reduced refrigerant vapor header 72, having a reduced refrigerant vapor header block valve 74. From the 4-way valve 76, reduced pressure refrigerant vapor can be directed to the compressor inlet line 64 via a reduced pressure refrigerant vapor feed line 78.

High pressure refrigerant vapor exiting the compressor 12 via a compressor discharge line 80 is directed to the 4-way valve 76. From the 4-way valve 76, high pressure refrigerant vapor can be alternatively directed to the pressurized refrigerant line 16 or to the evaporator 18 via an evaporator warming line 82, having evaporator warming line block valve 84.

Condensed refrigerant exiting the condenser 14 in the first condenser discharge line 66 is directed to the evaporator feed line 20 via a second condenser discharge line 86, having a second condenser discharge line block valve 88.

FIG. 6 illustrates the refrigeration system 10 in normal refrigeration mode. In such normal refrigeration mode, the 3-way valve 58 is set to direct refrigerant liquid and oil separated into the low point of the drop leg 26 and heated in the drop leg heater 28 to the first heated separates line 60. The 4-way valve 76 is set to direct reduced pressure refrigerant vapor from the top of the drop leg 26 to the compressor inlet line 64 via the reduced pressure refrigerant vapor feed line 78, and to direct high pressure refrigerant vapor from the compressor discharge line 80 to the condenser inlet line pressurized refrigerant line 16. The condenser warming line valve 70 is closed as is the evaporator warming line block valve 84. As can be readily seen, such normal refrigeration mode is adapted to repeatedly (a) compress refrigerant in a gaseous state within the compressor 12 and cool the refrigerant within the condenser 14 to yield refrigerant in a liquefied state; (b) flow refrigerant from the condenser 14 into the evaporator 18 wherein refrigerant is converted to a gaseous state; and (c) flow refrigerant from the evaporator 18 to the compressor 12.

FIG. 7 illustrates how the refrigeration system 10 can be quickly and easily converted periodically to a warm-up mode—to warm portions of the condenser 14 and the evaporator 18 which have become unduly chilled. In such heat-up mode, the 3-way valve 58 is set to direct refrigerant liquid and oil heated in the drop leg heater 28 to the second heated separates line 62. The condenser warming line valve 70 is opened and the second condenser discharge line block valve 88 is closed. As noted above, the operation of the condenser warming line valve 70 is controlled by the condenser warming line controller 90 which responds to the temperature of refrigerant in the pressurized refrigerant line 16. The 4-way valve 76 is set to direct high pressure refrigerant vapor exiting the compressor 12 to the evaporator 18 via the evaporator warming line 82. The evaporator warming line block valve 84 is opened. The 4-way valve 76 is also set to direct refrigerant from the pressurized refrigerant line 16 to the compressor inlet line 64.

Thus in this warm-up mode, the condenser 14 tends to function as an evaporator and the evaporator 18 tends to function as a condenser. In the warm-up mode, high pressure refrigerant is directed to the evaporator 18 via the compressor discharge line 80, the 4-way valve 76 and the evaporator warming line 82. Refrigerant flowing out of the evaporator 18 is directed to the condenser 14 via the drop leg 26, the drop leg heater 28, the 3-way valve 58, the second heated separates line 62 and the condenser warming line 68. Refrigerant flowing out of the condenser 14 is directed back to the compressor inlet line 64 via the pressurized refrigerant line 16, the 4-way valve 76 and the reduced pressure refrigerant vapor feed 78.

The embodiments of the invention illustrated in FIGS. 6 and 7 provide the refrigeration system with simple and effective capabilities to warm unduly cooled portions of the evaporator 18 and the condenser 14.

When compared to similar capacity refrigeration systems of the prior art, refrigeration systems of the invention uses markedly less refrigerant. In the embodiment illustrated in FIG. 4, for example, approximately 50% less refrigerant is required compared to similar capacity systems of the prior art. Refrigerant residence time within the evaporator 18 in the embodiment illustrated in FIG. 4 is approximately only 1% of the residence time required by similar capacity systems of the prior art.

Having thus described the invention, it should be apparent that numerous structural modifications and adaptations may be resorted to without departing from the scope and fair meaning of the instant invention as set forth herein above and described herein below by the claims.

What is claimed is:

1. A method of controlling a refrigeration system, wherein the refrigeration system comprises a refrigerant disposed within a fluid-tight circulation loop comprising a continuous length of tubing, the refrigeration system including a compressor, a condenser and an evaporator, the refrigerant being capable of existing in a liquefied state, a gaseous state and a two-phase state comprising both refrigerant in the liquefied state and refrigerant in the gaseous state, the evaporator having an outlet port and at least three evaporator zones in series provided by the continuous length of tubing, each evaporator zone having (i) an evaporator zone inlet port and (ii) an evaporator feed input control valve upstream of the inlet port, the method comprising the steps of:

(a) compressing refrigerant in a gaseous state within the compressor and cooling the refrigerant within the condenser to yield refrigerant in the liquefied state;

(b) flowing refrigerant from the condenser into the evaporator via the inlet port and the control valve of each evaporator zone, wherein the refrigerant partially exists in a two-phase state, and wherein refrigerant introduced into each evaporator zone through its inlet port and evaporator feed input control valve flows directly into the next evaporator zone in series until the refrigerant exits the evaporator through the outlet port in step (c); and (c) flowing refrigerant from the evaporator to the compressor.

2. The method of claim 1 wherein the continuous length of tubing continually and smoothly expands from the inlet port of the most upstream evaporator zone to the outlet port of the evaporator.

3. The method of claim 1 further comprising the step (d) of measuring the condition of the refrigerant with a plurality of refrigerant condition sensors.

4. The method of claim 3 wherein step (d) comprises measuring the condition of the refrigerant with a refrigerant condition sensor disposed within the evaporator upstream of the outlet port.

5. The method of claim 4, further comprising the step of controlling with a controller the flow rate of refrigerant to the evaporator in step (b) based upon the measured condition of the refrigerant condition of the refrigerant from step (d), wherein the controlling of the refrigerant flow rate to the evaporator is carried out by controlling the refrigerant flow rate to each of the evaporator zones with separate signals from the controller.

6. The method of claim 4, wherein the measuring of the refrigerant condition is carried out with a refrigerant condition sensor disposed within each of the evaporator zones.

7. The method of claim 1 wherein the flowing of refrigerant from the condenser into the evaporator in step (b) is carried out after cooling the refrigerant in a precooler disposed downstream of the condenser and upstream of the evaporator.

8. The method of claim 1 wherein the flowing of refrigerant from the condenser into the evaporator in step (b) is carried out after cooling the refrigerant by thermal contact with evaporating refrigerant in a precooler disposed downstream of the condenser and upstream of the evaporator thermal contact with evaporating refrigerant.

9. The method of claim 1 comprising the additional step of flowing a portion of the refrigerant exiting the evaporator to the inlet port of each of the evaporator zones.

10. The method of claim 1 comprising the additional step of flowing a portion of the refrigerant exiting the evaporator to the inlet port of each of the evaporator zones via a vapor booster operated to maintain two phase refrigerant volume in the evaporator at equilibrium with evaporator respective internal volume under all loading conditions.

11. The method of claim 1 wherein the condenser has a plurality of condenser zones, each condenser zone having a condenser zone inlet port.

12. A refrigeration system comprising:

(a) a fluid tight circulation loop comprising a continuous length of tubing, the fluid tight circulation loop including a compressor, a condenser and an evaporator, the circulating loop being configured to continuously circulate a refrigerant which is capable of existing in a liquefied state, a gaseous state and a two-phase state comprising both refrigerant in the liquefied state and refrigerant in the gaseous state, the evaporator having an outlet port and at least three evaporator zones in series provided by the continuous length of tubing, each evaporator zone having (i) an inlet port and (ii) an evaporator feed input control valve upstream of the inlet port, the circulation loop being further configured to (i) compress refrigerant in a gaseous state within the compressor and cool the refrigerant within the condenser to yield refrigerant in the liquefied state; (ii) flow refrigerant from the condenser into the evaporator via the inlet port and the control valve of each evaporator zone, wherein the refrigerant partially exists in a two-phase state, and wherein refrigerant introduced into each evaporator zone through its inlet port and evaporator feed input control valve flows directly into the next evaporator zone in series until the refrigerant exits the evaporator through the outlet port; and (iii) flow refrigerant from the evaporator to the compressor; and (b) a controller for controlling the flow rate of refrigerant to the evaporator based upon a measured condition of the refrigerant received from a refrigerant condition sensor disposed within the evaporator upstream of the evaporator outlet port.

13. The refrigeration system of claim 12 wherein the continuous length of tubing continually and smoothly expands from the inlet port of the most upstream evaporator zone to the outlet port of the evaporator.

14. The refrigeration system of claim 12 wherein the measured condition of the refrigerant is measured by—a plurality of refrigerant condition sensors.

15. The refrigeration system of claim 12 wherein the measuring of the refrigerant condition in the function described in (b) is carried out with a refrigerant condition sensor disposed within each of the evaporator zones.

16. The refrigeration system of claim 15 wherein the controlling of the refrigerant flow rate to the evaporator in the function described in (b) is carried out by controlling the refrigerant flow rate to each of the evaporator zones with separate signals from the controller.

17. The refrigeration system of claim 12 further comprising a precooler disposed downstream of the condenser and upstream of the evaporator, and wherein the flowing of refrigerant from the condenser into the evaporator in the function described in (a)(ii) is carried out after cooling the refrigerant in the precooler.

18. The refrigeration system of claim 12 further comprising recycling conduits for flowing a portion of the refrigerant exiting the evaporator to the inlet port of each of the evaporator zones.

19. The refrigeration system of claim 18 comprising a vapor pressure booster capable of maintaining two phase refrigerant in the evaporator at equilibrium under all loading conditions.

20. The refrigeration system of claim 12 wherein the condenser has a plurality of condenser zones, each condenser zone having a condenser zone inlet port.

21. The refrigeration system of claim 12 further comprising reversing conduits and valves for alternatively (i) flowing refrigerant from a discharge side of the compressor to the evaporator inlet ports without first flowing to the condenser, (ii) flowing refrigerant exiting the evaporator to the outlet port of the condenser, (iii) flowing refrigerant from the outlet port of the condenser to the condenser inlet ports and (iii) flowing refrigerant from the condenser inlet ports to a suction side of the compressor.

22. The refrigeration system of claim 21 wherein the reversing conduits and valves comprise a four-way valve.

23. The refrigeration system of claim 22 wherein the reversing conduits and valves comprise a condenser warming line and a condenser warming line controller for controlling the warming of the condenser using refrigerant flowing from the evaporator to the outlet of the condenser.

24. The refrigeration system of claim 23 further comprising a heater disposed downstream of the evaporator for heating refrigerant flowing from the evaporator to the outlet of the condenser.

25. The refrigeration system of claim 23 further comprising a drop leg disposed downstream of the evaporator for separating out liquid refrigerant and oils from the refrigerant stream exiting the evaporator and a heater disposed downstream of the drop leg for heating such liquid refrigerant and oils separated out of the refrigerant exiting the evaporator and for flowing such refrigerant and oils separated out of the refrigerant to the outlet of the condenser.

26. The refrigeration system of claim 12 further comprising a drop leg disposed downstream of the evaporator for separating out liquid refrigerant and oils from the refrigerant stream exiting the evaporator and a heater disposed downstream of the drop leg for heating such liquid refrigerant and oils separated out of the refrigerant exiting the evaporator and for flowing such refrigerant and oils separated out of the refrigerant to the outlet of the condenser.

27. A method of controlling a refrigeration system, wherein the refrigeration system comprises a refrigerant disposed within a fluid-tight circulation loop comprising a continuous length of tubing, the refrigeration system including a compressor, a condenser and an evaporator, the refrigerant being capable of existing in a liquefied state, a gaseous state and a two-phase state comprising both refrigerant in the liquefied state and refrigerant in the gaseous state, the evaporator having an outlet port and at least three evaporator zones in series provided by the continuous length of tubing, each evaporator zone having an (i) evaporator zone inlet port and (ii) an evaporator feed input control valve upstream of the inlet port, the method comprising the steps of:

(a) compressing refrigerant in a gaseous state within the compressor and cooling the refrigerant within the condenser to yield refrigerant in the liquefied state;

(b) flowing refrigerant from the condenser into the evaporator via the inlet port and the control valve of each evaporator zone, wherein the refrigerant partially exists in a two-phase state, and wherein refrigerant introduced into each evaporator zone through its inlet port and evaporator feed input control valve flows directly into the next evaporator zone in series until the refrigerant exits the evaporator through the outlet port in step (c);

(c) flowing refrigerant from the evaporator to the compressor;

d) measuring the condition of the refrigerant with a refrigerant condition sensor disposed within each of the evaporator zones; and e) controlling with a controller the flow rate of refrigerant to the evaporator in step (b) based upon the measured condition of the refrigerant condition of the refrigerant from step (d), wherein the controlling of the refrigerant flow rate to the evaporator is carried out by controlling the refrigerant flow rate to each of the evaporator zones with separate signals from the controller.

* * * * *